US007013540B2

(12) United States Patent
Wang et al.

(10) Patent No.: US 7,013,540 B2
(45) Date of Patent: Mar. 21, 2006

(54) ROTATING PIN CLASP APPARATUS

(75) Inventors: Chien-Jui Wang, Taipei (TW); Chia-Chuan Lin, Taipei Hsien (TW); Hung-ming Chen, Tai-Chung Hsien (TW)

(73) Assignee: BenQ Corporation, Tao-Yuan Hsien (TW)

( * ) Notice: Subject to any disclaimer, the term of this patent is extended or adjusted under 35 U.S.C. 154(b) by 0 days.

(21) Appl. No.: 10/709,817

(22) Filed: May 30, 2004

(65) Prior Publication Data

US 2005/0262667 A1 Dec. 1, 2005

(51) Int. Cl.
*A44B 9/18* (2006.01)

(52) U.S. Cl. ..... 24/709.4; 24/709.9; 24/711.5; 24/709.2

(58) Field of Classification Search ..... 24/13, 24/6, 12, 103, 709.2, 709.4, 706, 709.9, 711.5; 40/1.5, 1.6; 63/20

See application file for complete search history.

(56) References Cited

U.S. PATENT DOCUMENTS 1,624,458 A * 4/1927 Zook ..... 40/1.5
1,728,433 A * 9/1929 Mohun ..... 384/190.2
4,290,215 A * 9/1981 Kise ..... 40/1.5
5,245,844 A * 9/1993 Panzer ..... 63/1.16
5,457,852 A * 10/1995 Liu ..... 24/13

FOREIGN PATENT DOCUMENTS

JP 2000210108 A * 8/2000

* cited by examiner

*Primary Examiner*—James R. Brittain
(74) *Attorney, Agent, or Firm*—Winston Hsu

(57) ABSTRACT

A rotating pin clasp apparatus includes a base member with a cavity formed on the surface of the base member and a rod disposed in the cavity of the base member. The rod includes a recess and a pin utilized for fastening the rotating pin clasp apparatus, where a first end of the pin is rotatably attached to the rod at a pivot. The rod also includes a pin-retaining member for clasping a second end of the pin to the rod and a knob for rotating the rod in the cavity of the base member. A collar is formed on the base member and fitted around the recess of the rod for securing the rod to the base member and for permitting the rod to rotate in the cavity of the base member.

15 Claims, 13 Drawing Sheets

ROTATING PIN CLASP APPARATUS

BACKGROUND OF INVENTION

1. Field of the Invention

The present invention relates to a rotating pin clasp apparatus, and more specifically, to a rotating pin clasp apparatus used for fastening a portable device to fabric.

2. Description of the Prior Art

Safety pins are extensively used for conveniently fastening two pieces of fabric together for fastening another object to a piece of fabric. It is also possible to attach a safety pin to a portable device so that the portable device can be fastened to materials such as fabric very easily. In this case, the safety pin is part of the structure of the portable device, and is not meant to be removed to from the portable device.

While the portable device having a safety pin is fastened to fabric, the safety pin is serving the purpose of fastening the portable device to the fabric. However, when the portable device is not fastened to fabric, the safety pin is not being used. The owner of the portable device may feel that the portable device does not look very attractive with an exposed safety pin, but has no way of easily removing the safety pin. Moreover, it is also possible that the exposed safety pin may cause injury to the user of the portable device if the user accidentally stubs his or her finger on the unclasped pin.

SUMMARY OF INVENTION

It is therefore an objective of the claimed invention to provide a rotating pin clasp apparatus for hiding the pin when the pin is not in use in order to solve the above-mentioned problems.

According to the claimed invention, a rotating pin clasp apparatus includes a base member with a cavity formed on the surface of the base member and a rod disposed in the cavity. The rod includes a first recess, a pin having a first end rotatably attached to the rod at a pivot, and a pin-retaining member for clasping a second end of the pin to the rod. A first collar formed on the base member and fitted around the first recess for permitting the rod to rotate in the cavity of the base member.

It is an advantage of the claimed invention that the rod can be rotated when the rotating pin clasp apparatus is not fastened to fabric for hiding the pin out of view. Hiding the pin makes the rotating pin clasp apparatus look more attractive and prevents the pin from accidentally causing injury.

These and other objectives of the claimed invention will no doubt become obvious to those of ordinary skill in the art after reading the following detailed description of the preferred embodiment, which is illustrated in the various figures and drawings.

DETAILED DESCRIPTION

Figure 1:
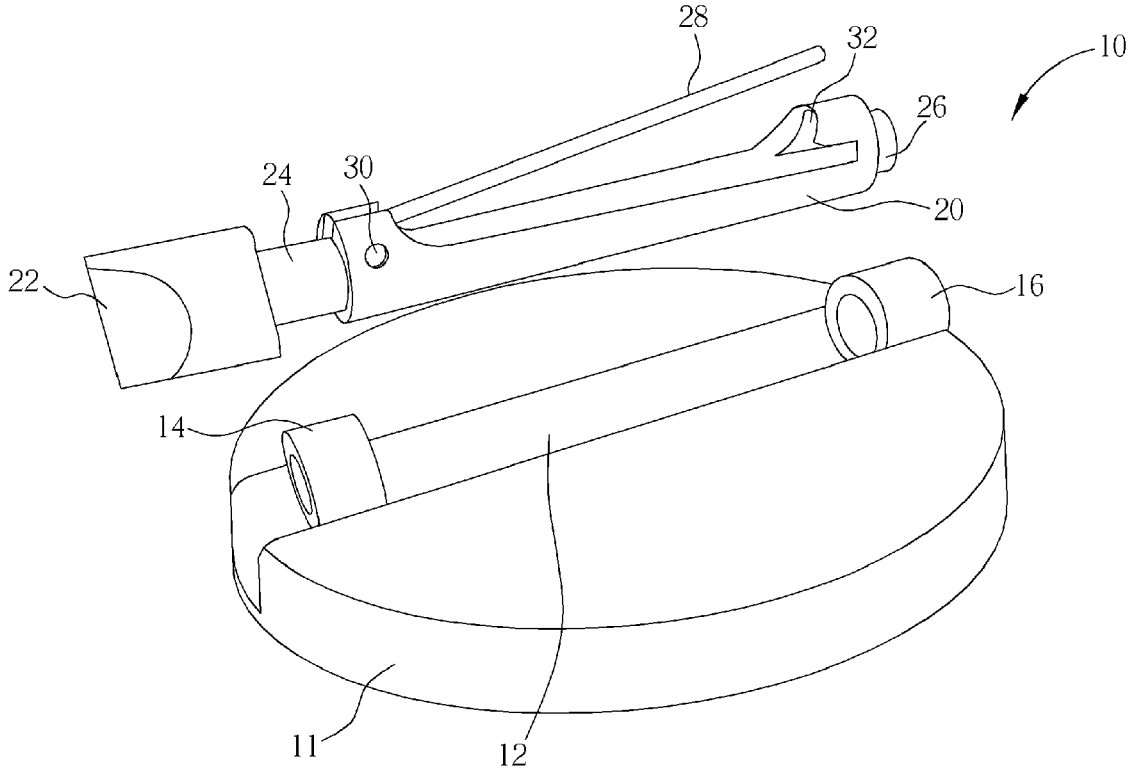
FIG. 1 is an exploded diagram of a portable device having a rotating pin clasp apparatus according to a first embodiment of the present invention.

Please refer to FIG. 1. FIG. 1 is an exploded diagram of a portable device 10 having a rotating pin clasp apparatus according to a first embodiment of the present invention. The portable device 10 comprises two main parts: a base member 11 and a rod 20. The base member 11 contains a cavity 12 which has the shape of half of a cylinder. In other words, the cavity 12 has a linear shape across the surface of the base member 11, and a cross-sectional area of the cavity 12 taken perpendicular to the linear direction of the cavity 12 is a semicircle. When fully assembled, the rod 20 is disposed in the cavity 12. Due to the half-cylindrical shape of the cavity 12, the rod 20 is able to rotate in the cavity 12, as will be shown below. The rod 20 contains a first recess 24 and a second recess 26, each having a diameter slightly smaller than the portions of the rod 20 adjacent to the first and second recesses 24 and 26. When the rod 20 is disposed in the cavity 12, the first recess 24 is surrounded by a first collar 14 and the second recess 26 is surrounded by a second collar 16. The first collar 14 and the second collar 16 are formed monolithically with the base member 11. When the portable device 10 is fully assembled with the rod 20 disposed in the cavity 12, the first collar 14 and the second collar 16 prevent the rod 20 from moving out of the cavity 12. The first collar 14 and the second collar 16 also have a circular shape for allowing the rod 20 to rotate in the cavity 12. A pin 28 is used for fastening the portable device 10 to material such as a piece of fabric, or any sturdy material that can be penetrated by a pin. One end of the pin 28 is attached to the rod 20 at a pivot 30. The pin 28 is able to rotate about the pivot 30 for allowing the pin 28 to be fastened. The other end of the pin 28 is shown as being unfastened in FIG. 1. When fastening the pin 28, the other end of the pin 28 is inserted into a pin-retaining member 32 for clasping the other end of the pin 28 to the rod 28. A knob 22 is formed at one end of the rod 20 for providing an easy and convenient way of rotating the rod 20 when the portable device 10 is fully assembled.

Figure 2:
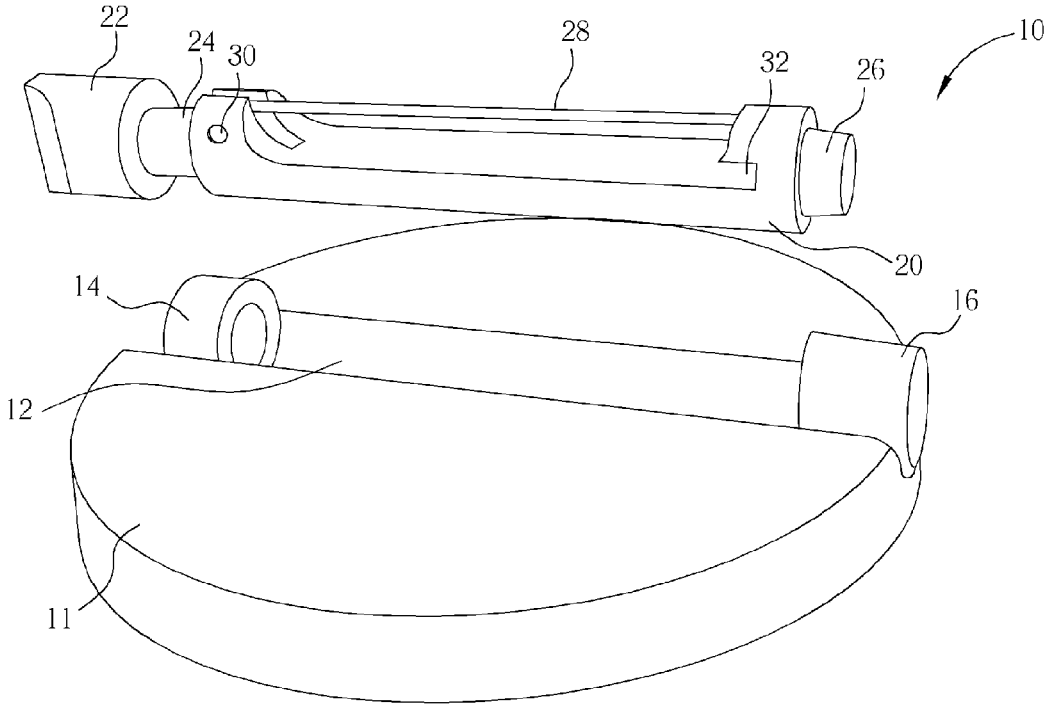
FIG. 2 is an exploded diagram of the portable device in which the pin is clasped with the pin-retaining member.

Please refer to FIG. 2. FIG. 2 is an exploded diagram of the portable device 10 in which the pin 28 is clasped with the pin-retaining member 32. The pin-retaining member 32 used to clasp the pin 28 is similar to that of a safety pin. The pin-retaining member 32 clasps the pin 28 when the portable device 10 is fastened to fabric, and also fastens the pin 28 to prevent the pin 28 from causing injury when the portable device 10 is not fastened to fabric.

Figure 3:
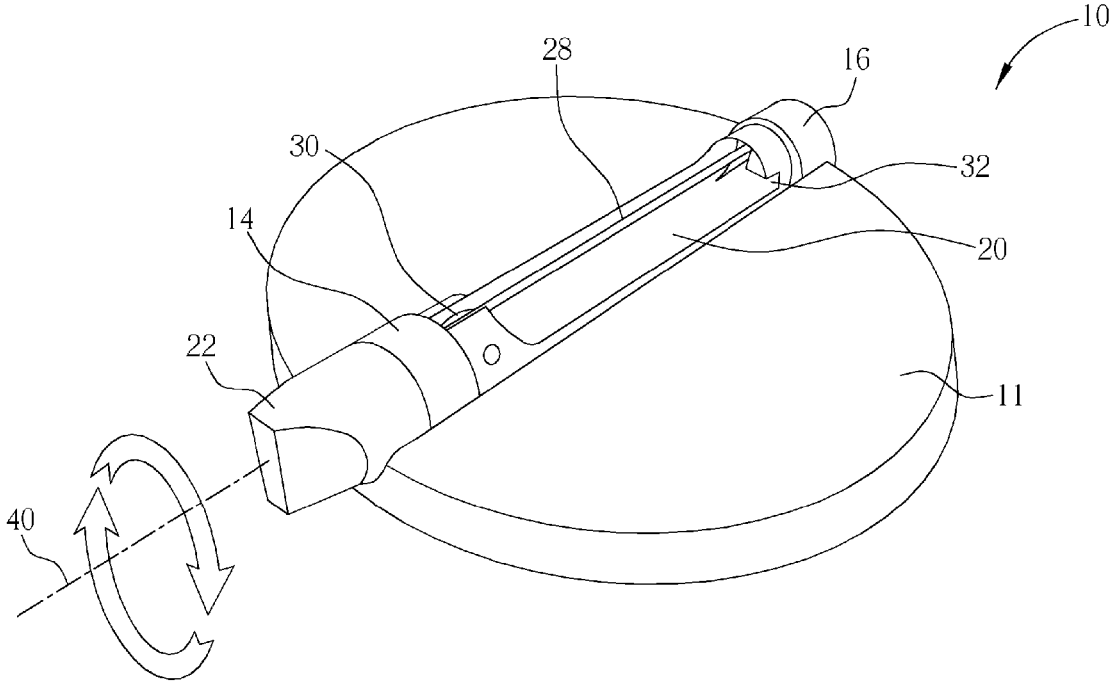
FIGS. 3–5 show how the rod is rotated about an axis in the assembled portable device.
Figure 4:
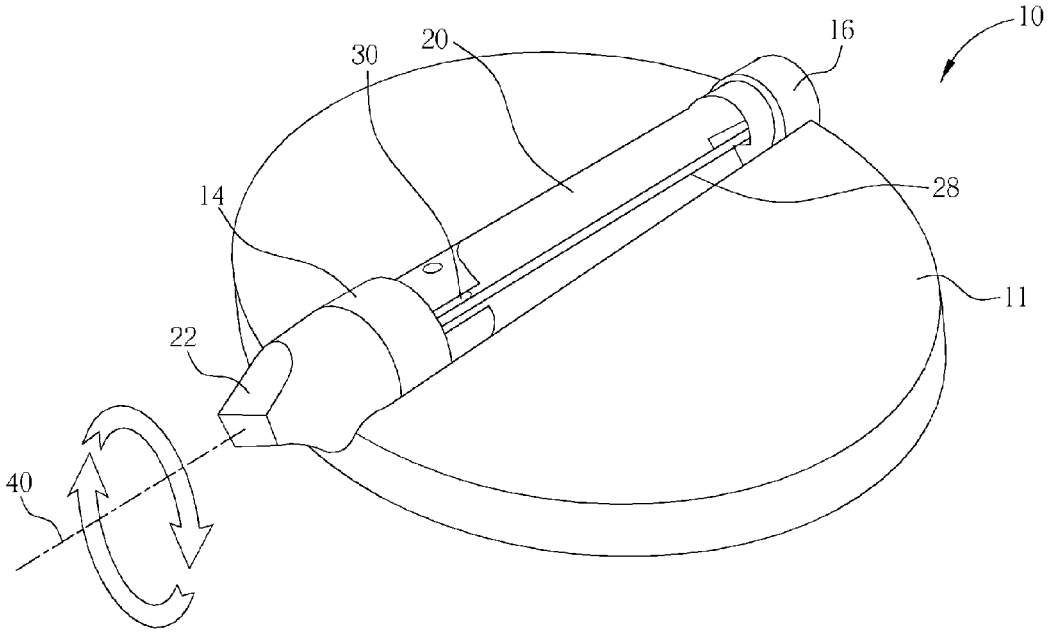
Figure 5:
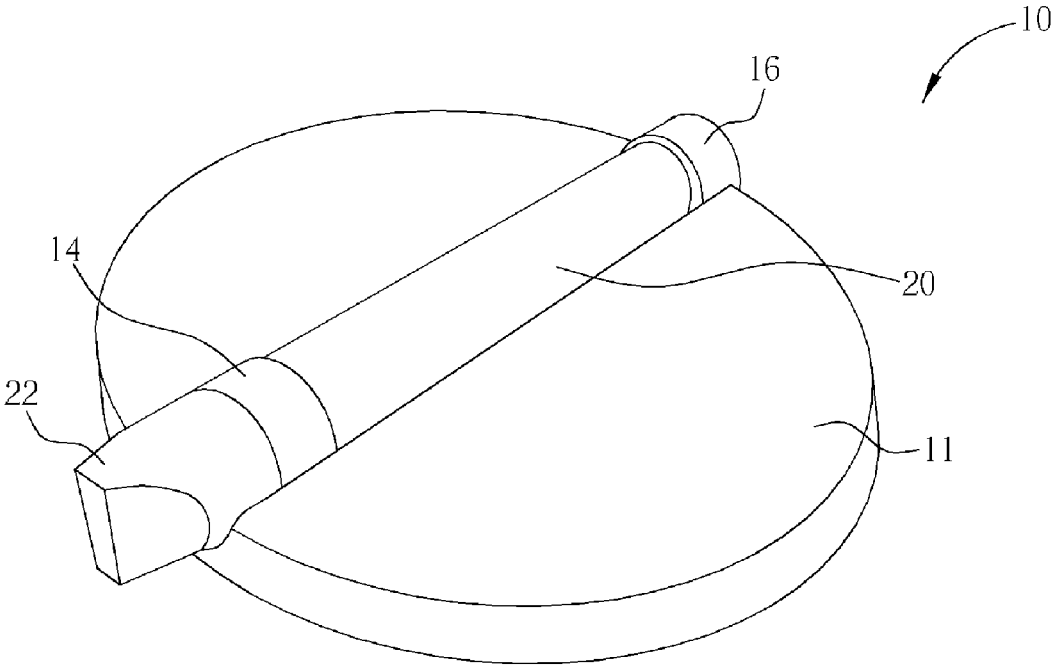
Figure 6:
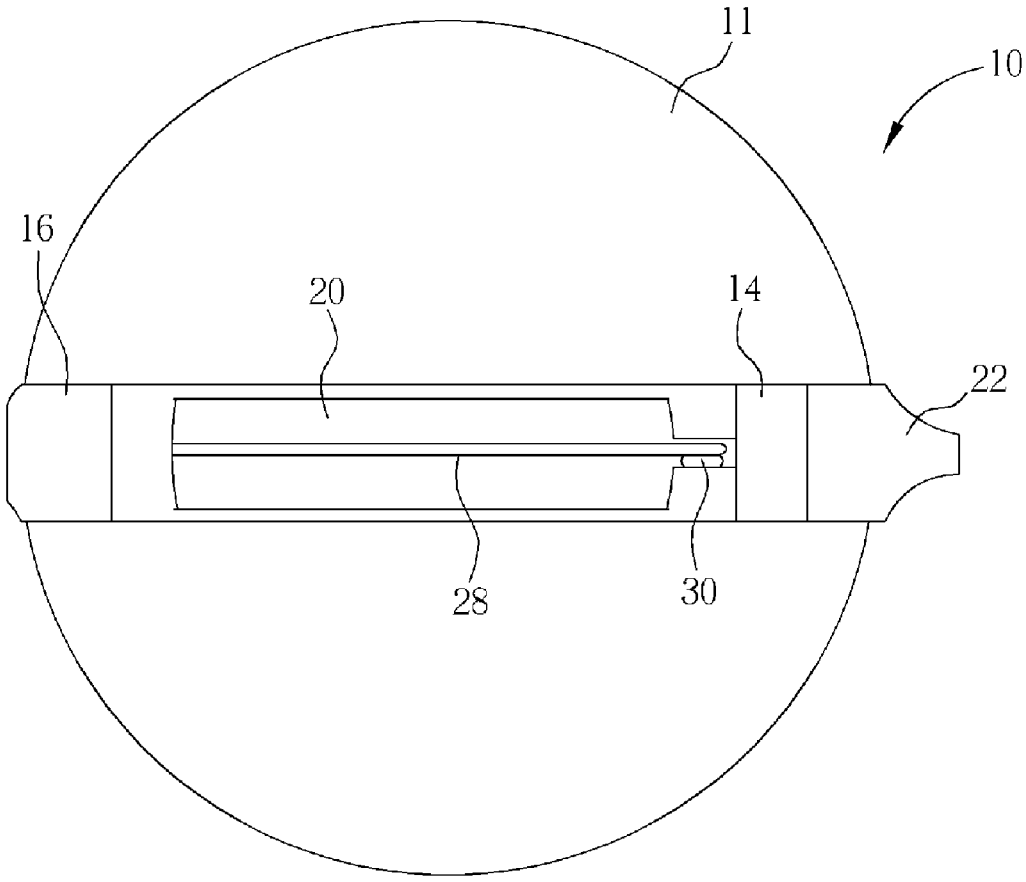
FIGS. 6–10 illustrate a top view, a front side view, a rear side view, a left side view and a right side view of the portable device according to the present invention.
Figure 7:
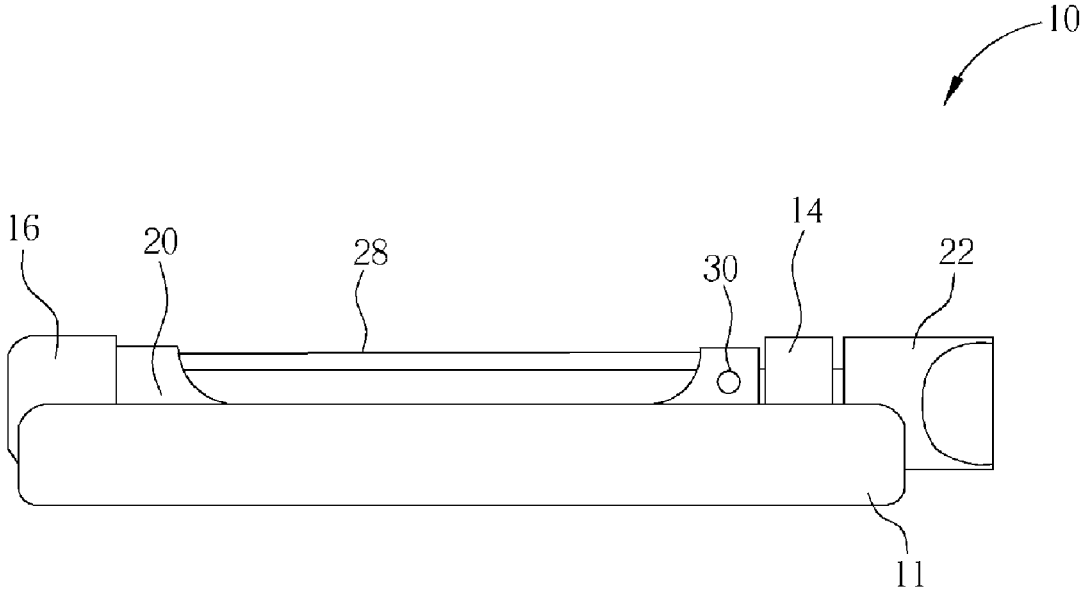
Figure 8:
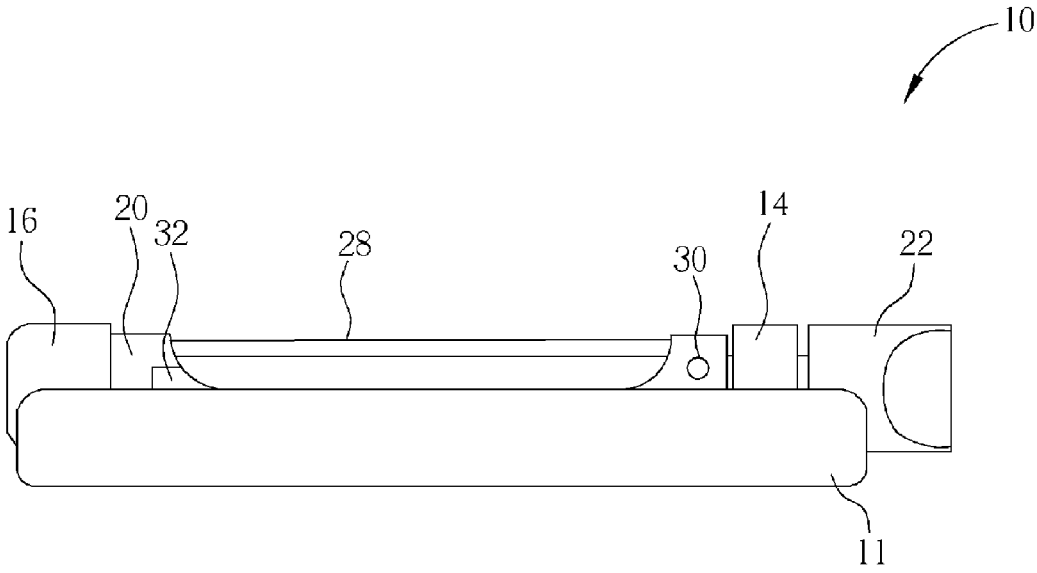
Figure 9:
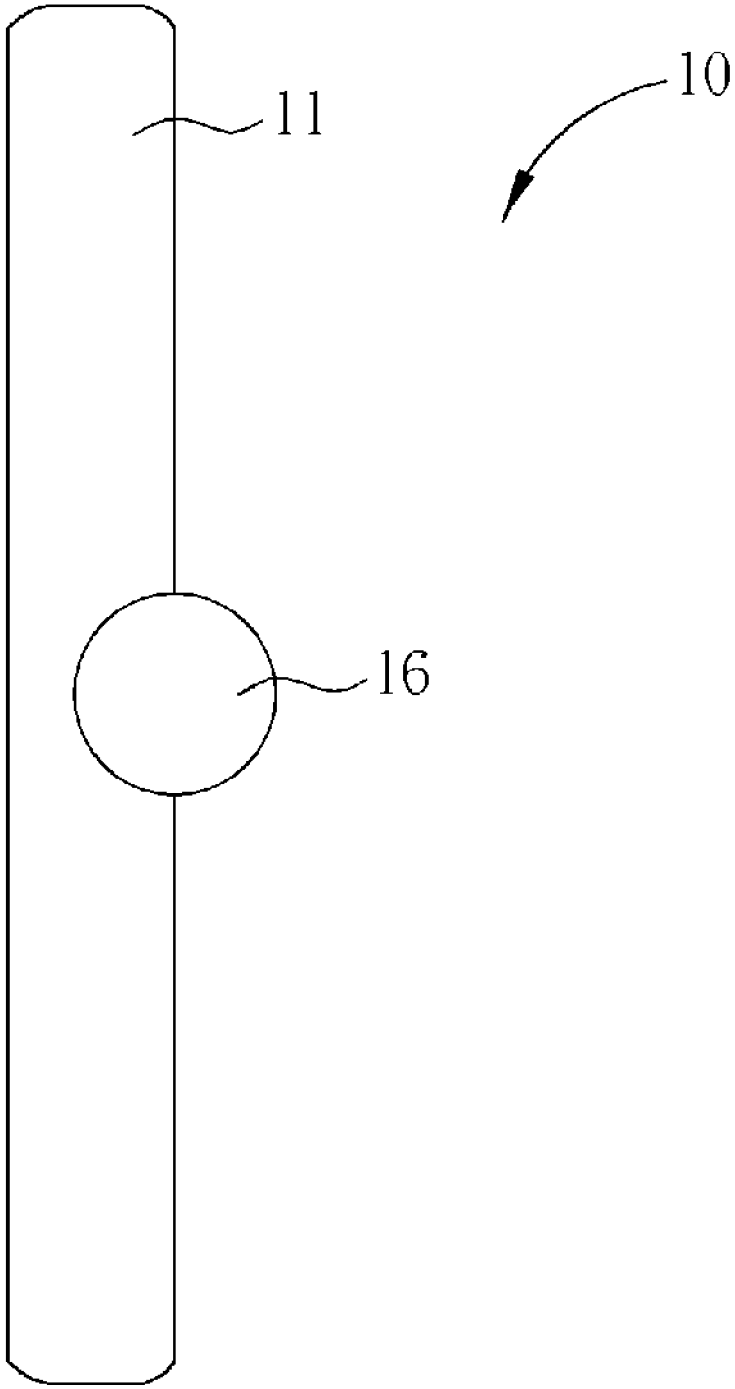
Figure 10:
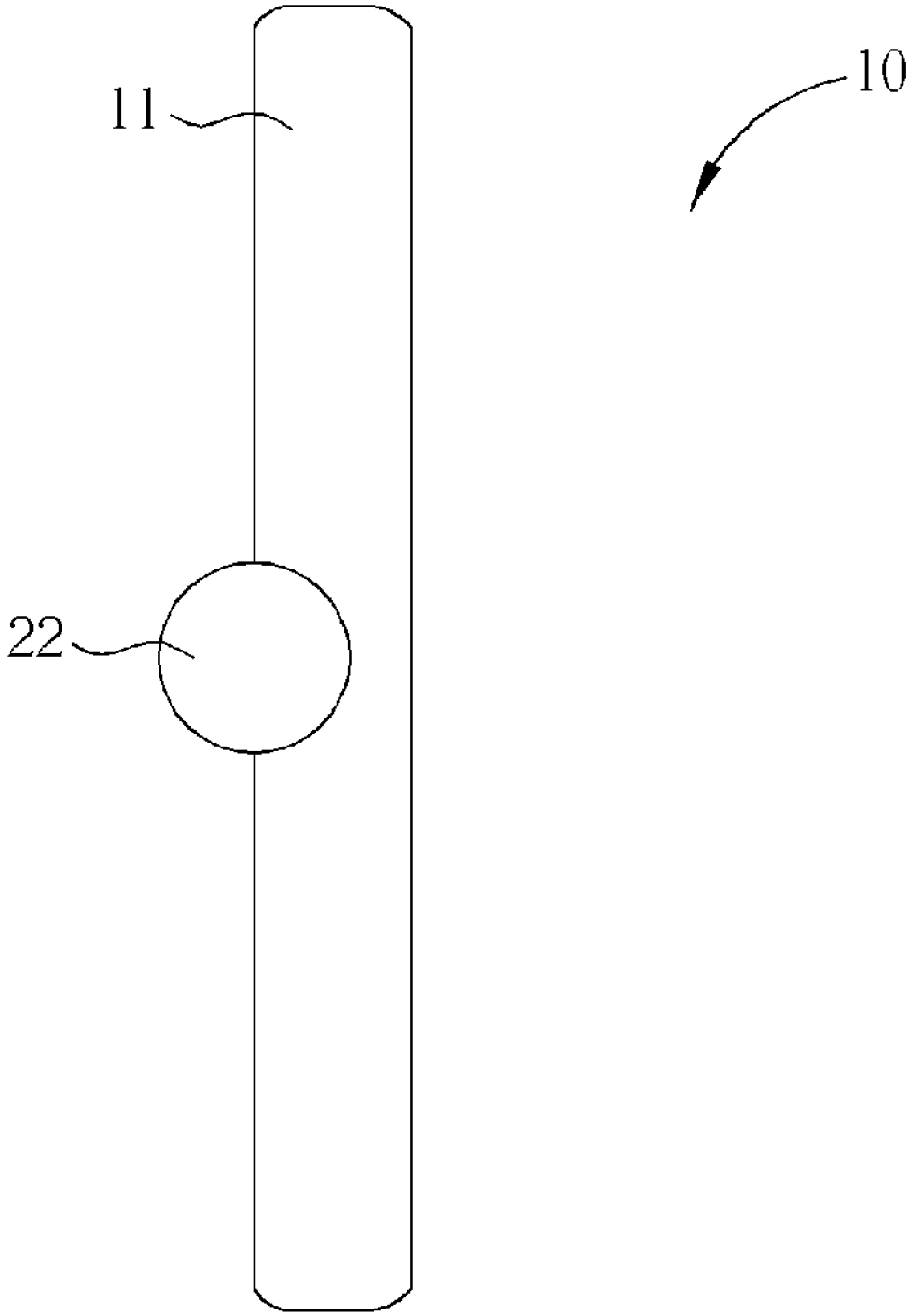

Please refer to FIGS. 3–5. FIGS. 3–5 show how the rod 20 is rotated about an axis 40 in the assembled portable device 10. In FIG. 3, the pin 28 is facing out away from the base member 11. This is the position the rod 20 should be in when the pin 28 of the portable device 10 is to be fastened to fabric. The knob 22 can be used to rotate the rod 20 in either a clockwise or counter clockwise direction. FIG. 4 shows the portable device 10 after the rod 20 has been rotated about 45 degrees in the clockwise direction with respect to the position shown in FIG. 3. FIG. 5 shows the portable device 10 after the rod 20 has been rotated 180 degrees with respect to the position shown in FIG. 3.

Therefore, in FIG. 5, the pin 28 is completely hidden and out of view. By rotating the rod 20 so that the pin 28 is out of view, the portable device 10 looks more attractive, prevents the pin 28 from unintentionally snagging on another object, and prevents the pin 28 from accidentally unclasping from the pin-retaining member 32.

As can be seen in FIG. 3 and FIG. 4, the pivot 30 in which the pin 28 is attached to the rod 20 is actually a wire coil that is commonly used in a safety pin. The wire coil provides a spring force on the pin 28 that urges the other end of the pin 28 away from the rod 20. Thus, when the pin 28 is unclasped from the pin-retaining member 32, the pin 28 will spring away from the rod 20 much like a safety pin for allowing the pin 28 to be used to fasten the portable device 10 to fabric.

Please refer to FIGS. 6–10. FIGS. 6–10 illustrate a top view, a front side view, a rear side view, a left side view and a right side view of the portable device 10 according to the present invention. In each of the FIGS. 6–10, the rod 20 is rotated to a position in which the pin 28 is facing out away from the base member 11.

Figure 11:
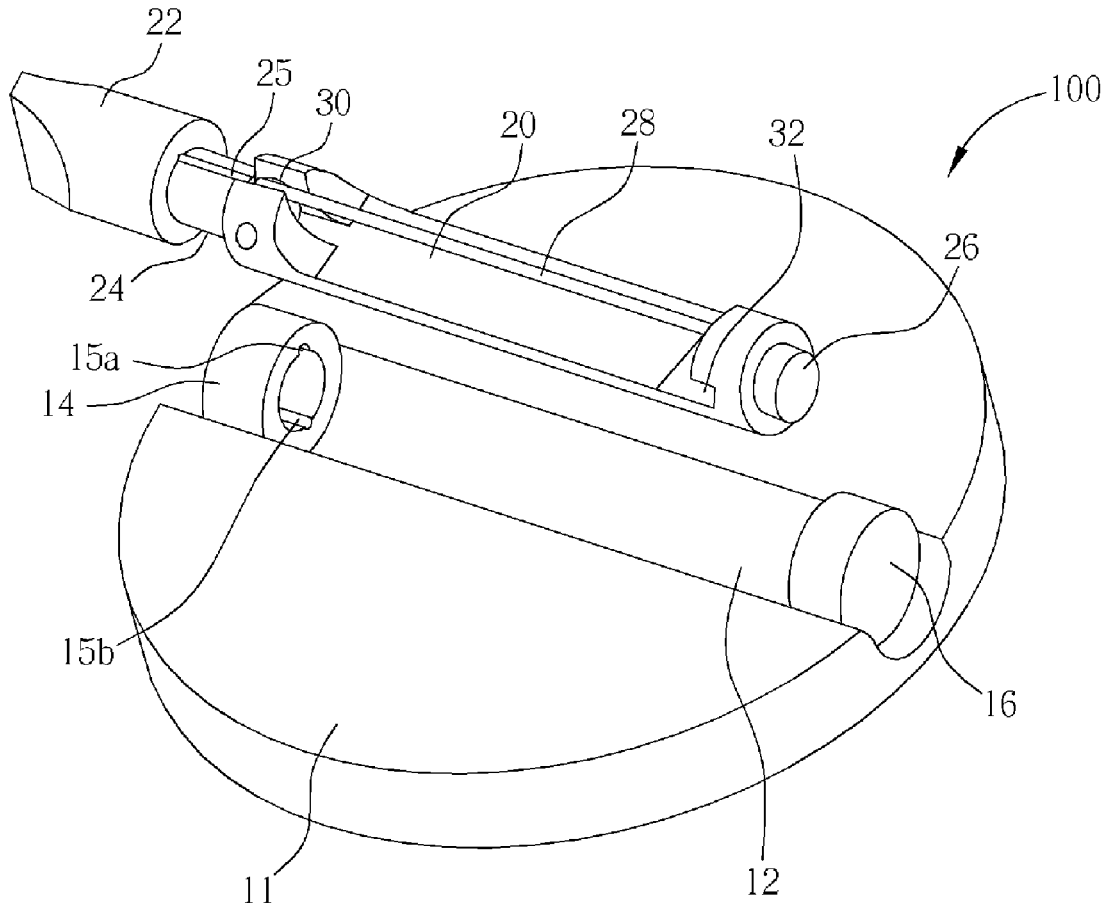
FIGS. 11–12 are exploded diagrams of a portable device having a rotating pin clasp apparatus according to a second embodiment of the present invention.
Figure 12:
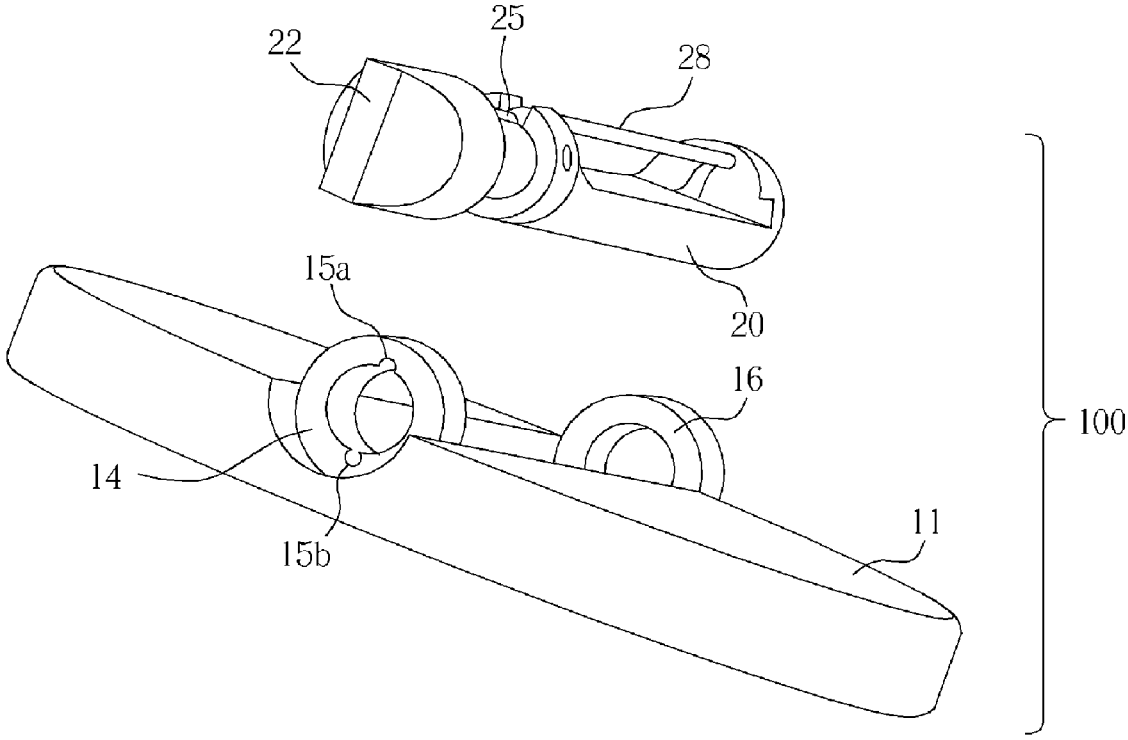

Please refer to FIGS. 11–12. FIGS. 11–12 are exploded diagrams of a portable device 100 having a rotating pin clasp apparatus according to a second embodiment of the present invention. The only difference between the portable device 10 of the first embodiment and the portable device 100 of the second embodiment is the formation of a protruding rib 25 on the first recess 24 and the formation of a first indentation 15*a* and a second indentation 15*b* on the first collar 14. The protruding rib 25 is used to conveniently hold the rod 20 in one of two positions. As the rod 20 is rotated, the protruding rib 25 will move along the inside surface of the first collar 14 and will eventually insert into the first indentation 15*a* or the second indentation 15*b*. The first indentation 15*a* is formed on a top part of the inside surface of the first collar 14 at a point farthest away from the base member 11. On the other hand, the second indentation 15*b* is formed on a bottom part of the inside surface of the first collar 14 at a point closest to the base member 11. As can be seen from FIG. 11, the protruding rib 25 is formed on the surface of the first recess 24 and is preferably placed on the same side or the opposite side of the rod 20 as the pin 28.

When the protruding rib 25 is inserted into either the first indentation 15*a* or the second indentation 15*b*, the rod 20 is fixed and cannot rotate unless a torque greater than a predetermined value is applied to the rod 20 to rotate the rod 20. Although more than two indentations can be formed on the inside surface of the first collar 14, the use of two indentations provides a simple and functional design. When the protruding rib 25 is inserted into the first indentation 15*a*, the pin 28 faces out away from the base member 11. This allows the pin 28 to be unclasped from and clasped to the pin-retaining member 32 for fastening the portable device 100 to fabric. When the protruding rib 25 is inserted into the second indentation 15*b*, the pin faces in towards the base member 11 and is out of view. Therefore, the use of the protruding rib 25 in conjunction with the first indentation 15*a* and the second indentation 15*b* prevents the rod 20 from rotating accidentally and ensures that the rod 20 and the pin 28 are positioned as the user wishes them to be.

Figure 13:
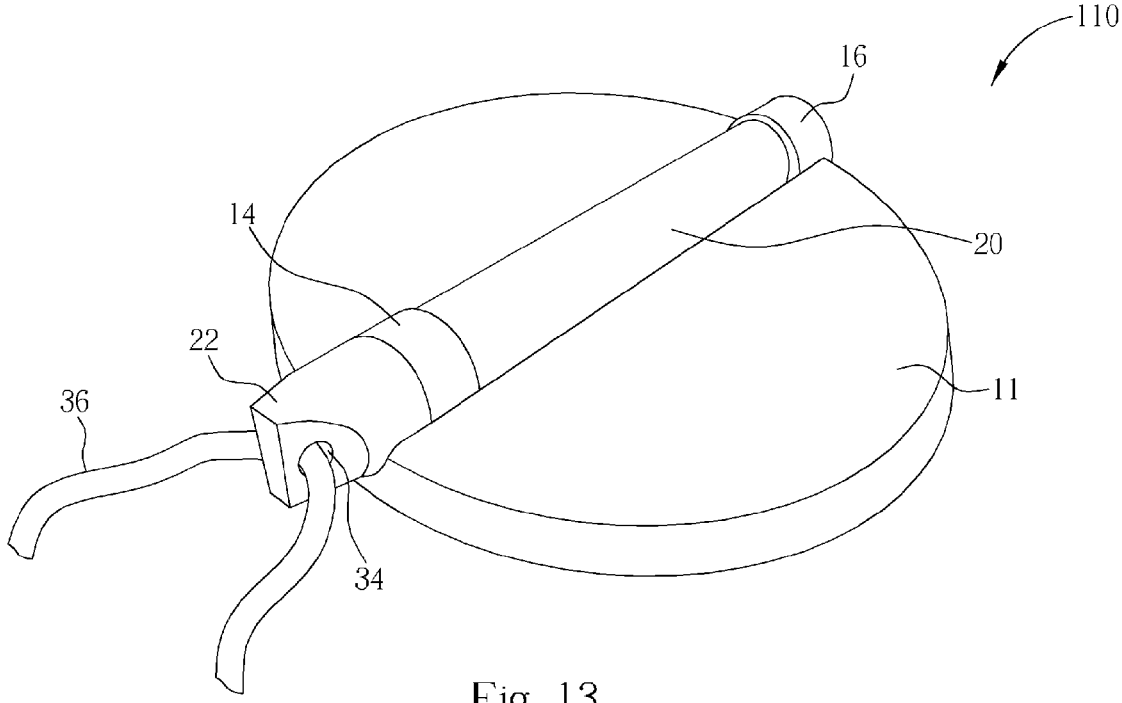
FIG. 13 is a diagram of a portable device having a rotating pin clasp apparatus according to a third embodiment of the present invention.

Please refer to FIG. 13. FIG. 13 is a diagram of a portable device 110 having a rotating pin clasp apparatus according to a third embodiment of the present invention. The only difference between the portable device 10 of the first embodiment and the portable device 110 of the third embodiment is the formation of a hole 34 in the knob 22 for allowing a string 36 to be tied through the hole 34. The string 36 can be used for carrying the portable device 110 by, for example, placing the string 36 around the hand or neck of the user. Please keep in mind that the hole 34 does not have to be formed in the knob 22, and can be formed on any other location in the portable device 110.

In contrast to the prior art, a portable device having a rotating pin clasp apparatus according to the present invention allows the rod containing the clasping pin to be rotated when the rotating pin clasp apparatus is not fastened to fabric for hiding the pin out of view. Hiding the pin makes the rotating pin clasp apparatus look more attractive, prevents the pin from snagging other objects, and prevents the pin from accidentally causing injury.

Those skilled in the art will readily appreciate that numerous modifications and alterations of the device may be made without departing from the scope of the present invention. Accordingly, the above disclosure should be construed as limited only by the metes and bounds of the appended claims.

What is claimed is:

1. A rotating pin clasp apparatus, comprising:

a base member with a cavity formed on the surface of the base member;

a rod disposed in the cavity, the rod comprising:

a first recess comprising a protruding rib formed on the outer surface of the first recess;

a pin having a first end rotatably attached to the rod at a pivot; and a pin-retaining member for clasping a second end of the pin to the rod; and a first collar formed on the base member and fitted around the first recess for permitting the rod to rotate in the cavity of the base member, the first collar comprising a first indentation formed on the inside surface of the first collar, wherein the protruding rib and the first indentation have complementary shapes and the protruding rib inserts into the first indentation for preventing the rod from rotating in the cavity of the base member.

2. The rotating pin clasp apparatus of claim 1 wherein the rod further comprises a second recess and a second collar is formed on the base member and fitted around the second recess.

3. The rotating pin clasp apparatus of claim 2 wherein the first recess is formed at a first end of the rod and the second recess is formed at a second end of the rod.

4. The rotating pin clasp apparatus of claim 1 wherein the pin contains a wire coil at the first end of the pin for providing a spring force for urging the pin away from the rod.

5. The rotating pin clasp apparatus of claim 1 wherein a cross-sectional area of the cavity of the base member is a semicircle for permitting the rod to rotate in the cavity of the base member.

6. The rotating pin clasp apparatus of claim 1 wherein when the protruding rib is inserted into the first indentation, the rod is not capable of rotating in the cavity of the base member unless a torque greater than a predetermined value is applied to the rod.

7. The rotating pin clasp apparatus of claim 6 wherein the protruding rib is formed on the same side of the rod as the pin.

8. The rotating pin clasp apparatus of claim 1 wherein the first indentation is formed on a top portion of the inside surface of the first collar farthest away from the base member.

9. The rotating pin clasp apparatus of claim 1 wherein the first indentation is formed on a bottom portion of the inside surface of the first collar closest to the base member.

10. The rotating pin clasp apparatus of claim 1 wherein a second indentation substantially identical to the first indentation is formed on the inside surface of the first collar.

11. The rotating pin clasp apparatus of claim 10 wherein the first indentation is formed on a top portion of the inside surface of the first collar farthest away from the base member and the second indentation is formed on a bottom portion of the inside surface of the first collar closest to the base member.

12. The rotating pin clasp apparatus of claim 1 further comprising a knob formed at a first end of the rod for rotating the rod in the cavity of the base member.

13. The rotating pin clasp apparatus of claim 12 wherein a hole is formed through the knob for receiving a string passing through the hole, the string being used for carrying the rotating pin clasp apparatus.

14. The rotating pin clasp apparatus of claim 12 wherein the first recess is formed on the rod between the knob and the first end of the pin.

15. The rotating pin clasp apparatus of claim 1 wherein when the rotating pin clasp apparatus is not fastened to fabric, the rod is capable of being rotated to hide the pin out of view.

* * * * *